US005878512A

United States Patent [19]

Cooper et al.

[11] Patent Number: 5,878,512

[45] Date of Patent: Mar. 9, 1999

[54] PROTECTIVE OVERSHOE

[76] Inventors: Jeffrey A. Cooper, 496 Oakridge, Tooele, Utah 84074; Ray B. Hansen, 3779 W. Norfolk Bay, South Jordan, Utah 84095

[21] Appl. No.: 96,762

[22] Filed: Jun. 12, 1998

Related U.S. Application Data

[63] Continuation of Ser. No. 858,326, May 19, 1997, Pat. No. 5,765,297.

[51] Int. Cl.[6] ..... A43B 1/02; A43B 1/10

[52] U.S. Cl. ..... 36/84; 36/7.3; 36/107

[58] Field of Search ..... 36/4, 107, 72 R, 36/11.3, 7.1 R, 7.3, 2 R, 73, 84

[56] References Cited

U.S. PATENT DOCUMENTS

| | | | |
|---|---|---|---|
| 1,717,127 | 6/1929 | Toole . | |
| 1,877,182 | 9/1932 | Konecke . | |
| 2,297,656 | 9/1942 | L'Hollier | 36/7.3 |
| 3,280,485 | 10/1966 | Arnold | 36/7.3 |
| 3,308,560 | 3/1967 | Jones | 36/4 |
| 4,102,062 | 7/1978 | Adams | 36/72 R |
| 4,366,629 | 1/1983 | Scherz | 36/4 |
| 4,524,530 | 6/1985 | Greenway | 36/113 |
| 4,689,900 | 9/1987 | Ishibashi | 36/7.1 R X |
| 4,896,438 | 1/1990 | DeBease | 36/7.1 R |
| 4,897,939 | 2/1990 | Harrington | 36/108 |
| 4,908,960 | 3/1990 | Hoyt, Jr. | 36/7.1 R |
| 4,908,963 | 3/1990 | Krajcir et al. | 36/77 |
| 5,033,209 | 7/1991 | Bathurst et al. | 36/7.3 |
| 5,067,260 | 11/1991 | Jenkins, Jr. | 36/7.1 R |
| 5,165,182 | 11/1992 | Michael | 36/1.5 |
| 5,210,963 | 5/1993 | Harwood | 36/72 R X |
| 5,331,751 | 7/1994 | Harwood | 36/77 |
| 5,765,297 | 6/1998 | Cooper et al. | 36/84 |
| 8,689,900 | 9/1987 | Ishibashi | 36/103 |

FOREIGN PATENT DOCUMENTS

| | | | |
|---|---|---|---|
| 0185588 | 6/1986 | European Pat. Off. | 36/7.3 |
| 130091 | 4/1902 | Germany | 36/7.3 |
| 2060661 | 10/1970 | Germany . | |
| 2655384 | 6/1977 | Germany | 36/107 |
| 2655384 | 12/1977 | Germany . | |
| 2055549 | 3/1981 | United Kingdom | 36/107 |
| 2060350 | 5/1981 | United Kingdom | 36/107 |
| 2014372 | 9/1992 | WIPO | 36/107 |
| WO92/14372 | 9/1992 | WIPO . | |

OTHER PUBLICATIONS

Iron Age Safety Shoes 1994 Product Catalog, p. 64.
Iron Age Safety Shoes 1994 Product Catalog, p. 68.
Iron Age Safety Shoes 1994 Product Catalog, p. 72.
Industrial Supply Company product catalog, Black Diamond Outsoles products, p. 35.
"American National Standard for Personnel Protection—Protective Footwear" report, May 5, 1983, pp. 1–20.
Product brochure for heavy duty rubber shoes and boots.
Product brochure for western boot rubber shoes and boots.

*Primary Examiner*—B. Dayoan
*Attorney, Agent, or Firm*—Madson & Metcalf

[57] ABSTRACT

A protective overshoe which reduces the risk of injury from industrial impact, compression, chemical, puncture, and electrical hazards and simultaneously protects both a foot and a street shoe worn by the foot is described. The overshoe may include a protective sole, a protective upper, and a toe box. The protective sole is made with conventional materials such as butyl rubber, neoprene rubber, polyvinyl chloride, nitrile, and combinations thereof. An optional puncture guard in the sole protects against punctures. The protective upper is large enough to substantially cover the upper of the street shoe. Protective uppers are made of the same or similar materials as those used in the protective soles. The toe box, which substantially covers and protects the user's toes, is formed of a conventional rigid material such as steel, rigid plastic, or fiberglass. The overshoe may also include a metatarsal guard, an upper which extends up along the user's calf, or a strap for tightening the overshoe about the street shoe.

20 Claims, 7 Drawing Sheets

PROTECTIVE OVERSHOE

This application is a continuation of U.S. patent application Ser. No. 08/858,326 filed May 19, 1997, now U.S. Pat. No. 5,765,297.

FIELD OF THE INVENTION

The present invention relates to protecting a foot and a street shoe worn upon the foot from industrial hazards. More particularly, the present invention relates to a method and device for protecting a foot and footwear by placing them within a protective overshoe which preferably includes a toe box that is impact-resistant and compression-resistant.

TECHNICAL BACKGROUND OF THE INVENTION

Visitors of various kinds make occasional but necessary visits to mines, mills, labs, factories, warehouses, and other industrial sites. Such visitors include management personnel, inspectors and other regulatory officials, attorneys, investors, and other people who have business at the site but do not normally work there. The results of such visits may have longlasting effects on both the site and the lives of the people who work there each day. It is important that such visits be conducted both safely and efficiently.

Unfortunately, materials and material-handling processes in industrial environments pose a variety of hazards to occasional visitors, including in particular hazards to the visitor's feet. For instance, acids, solvents, alkalis, and other chemicals are used in a wide variety of mining, manufacturing, and engineering applications. Many industrial environments also contain boulders, large pipes, concrete blocks, heavy equipment, and other objects which can seriously injure a visitor's feet by impact or by compression. Sharp rock fragments, nails, and similar objects also expose visitors to the risk of receiving puncture wounds in the feet.

In other situations the visitor may pose a risk to the environment. Thus, visitors near explosives or delicate electronic equipment must wear dissipating shoes and other gear to avoid building up a dangerous static electric charge. As used herein, "hazards" include risks created by a visitor to an industrial environment, risks created by the industrial environment, and risks created jointly by the visitor and the environment. Industrial environments include, without limitation, mining sites, manufacturing facilities, metal working sites, warehouses, airport and shipyard baggage handling facilities, and chemical research and development facilities.

Various means are available to control the interaction of workers with their daily industrial environment to the extent necessary to ensure the safety of each. Proper-training, safety procedures, and inspections are all important measures for minimizing hazards. In addition, employees whose feet are regularly exposed to chemical, impact, compression, puncture, electric shock, and static electric hazards in the course of their daily work are generally equipped with protective footwear. For example, chemical workers wear workboots that are made of materials chosen for their impermeability and their ability to resist corrosion and other effects of the chemical hazards in question.

Mining and construction workers likewise wear workboots that are equipped with protective toe boxes to resist impact and compression forces from falling rocks, rolling machines, and like hazards. The toe boxes, which are constructed of strong, rigid materials, cover the top and sides of the toes, and may extend beneath the toes. The toe box may also be extended or supplemented by a rigid metatarsal guard which protects the metatarsal bones of the worker's foot.

Unlike workers, visitors to industrial sites must generally choose between inadequate options. In some cases the visitor may choose to forego special protective footwear and simply wear street shoes during the visit. As used herein, "street shoes" include conventional dress shoes, running shoes, sandals, cowboy boots, other boots, socks, pumps, and other footwear which does not provide substantial protection against industrial hazards. Choosing to wear street shoes rather than protective workboots often places the visitor's feet at risk of being burned, crushed, punctured, shocked, or otherwise seriously injured.

A secondary drawback of simply wearing street shoes during a visit is that the street shoes themselves may be damaged, regardless of whether the visitor's feet are harmed. Grease, paint, sharp rocks, dust, mud, solvents, and other chemicals may all leave the visitor's feet unharmed while nonetheless ruining a good pair of shoes. An additional disadvantage is that the failure to utilize adequate protective footwear may be a violation of industrial safety laws and regulations.

Thus, the visitor may choose to remove the street shoes and replace them with a borrowed pair of protective workboots. Although this approach improves the visitor's chance of emerging intact from the visit it nevertheless has several disadvantages. For instance, the borrowed workboots are unlikely to fit properly. Workboots which are too large or too small may cause severe discomfort during the course of a longer visit. Moreover, boots that do not fit may cause the visitor to stumble at an inopportune or even a dangerous time.

To ensure a proper fit, a large selection of workboots of different sizes may be kept on hand. However, each pair of workboots typically costs somewhere in the range from $80 to is $150, so keeping a selection of different sizes on hand for use by occasional visitors may be financially impractical. Such a collection of workboots is also bulky and cumbersome to store.

The visitor who replaces street shoes with borrowed workboots also faces the unpleasant and unhygienic prospect of wearing shoes which were previously (and perhaps recently) worn by numerous other people. Moreover, the desired path during the visit may not take the visitor back to the location at which the street shoes were removed, so it may be necessary for the visitor to carry the removed street shoes by hand throughout the visit.

An alternative approach is for the visitor to obtain a personal pair of workboots rather than borrowing a pair. The street shoes are removed at the visitor's office and replaced by workboots, which are then worn to the industrial site. After the visit, the visitor wears the workboots back to the office and there replaces them with the street shoes. The street shoes are not exposed to industrial hazards because they are not taken to the industrial site, and the visitor's feet are protected during the visit by the workboots.

However, workboots are relatively expensive. Moreover, this approach poses a serious risk of contamination. Chemicals, grease, particulates, mud, and other substances carried from the work site on the workboots may contaminate the visitor's office, residence, or other areas of the community at large. Although rubberized workboots can be hosed off before leaving the site, such a cleaning is not always done thoroughly. In addition, workboots constructed of leather, fiber, and other porous materials are not easily decontaminated.

A different approach is to fasten an external rigid guard made of plastic, fiberglass, or steel over a conventional street shoe. According to this approach, a rigid toe cap or metatarsal guard is placed over the toe end of a street shoe and then secured with a strap which wraps around the heel of the street shoe. This approach has the advantage of providing protection against impact and compression hazards without requiring that the protective device's user remove the street shoes. Thus, the external guard may be worn without carrying the user's street shoes by hand or forcing the user to wear a workboot recently worn by someone else.

Unfortunately, such external rigid guards have several disadvantages. Because external guards are noisy and unattractive, they draw unnecessary attention to the user's foot. By causing the user to feel self-conscious and uncomfortable, external guards interfere with the user's concentration on the business purpose of the visit. Even worse, in some cases an external rigid guard actually increases the risk of injury to the user by creating tripping hazards. External guards include many exposed edges which may catch on a rock, a step, or another protrusion. External guards may also cause unsightly wear to the exterior of the street shoe. In addition, such external guards do not protect the user's foot or the user's street shoes against chemical, electrical, or puncture hazards.

Thus, it would be an advancement in the art to provide foot and street shoe protection which does not require users employing the protection to replace their street shoes with workboots or to supplement them with conventional rigid external guards.

It would be an additional advancement to provide such protection which protects the feet and the street shoes worn by the feet from impact hazards and from compression hazards.

The art would be advanced still further if such protection were provided against chemical hazards, against puncture hazards, and against hazards caused by electricity.

It would also be an advancement to provide such protection without increasing the risk that a person using the protection will trip.

A method and a device providing such protection are disclosed and claimed herein.

BRIEF SUMMARY OF THE INVENTION

The present invention relates to a protective overshoe which reduces the risk of injury from industrial impact, compression, chemical, puncture, and electrical hazards. Unlike conventional protective devices, the overshoe of the present invention simultaneously protects both a foot and a street shoe worn by the foot. Different embodiments of the overshoe protect against various combinations of industrial hazards.

A preferred embodiment of the protective overshoe includes a protective sole, a protective upper, and a toe box. The protective sole is slip-resistant and large enough to substantially cover the sole of the street shoe. The inner side of the protective sole is optionally provided with a heel cavity for receiving the heel of the street shoe to provide a secure, comfortable fit.

To make the overshoe easy to put on and take off, the protective upper and sole are formed of flexible materials. Embodiments intended to protect principally against impact or compression hazards contain leather, rubber, or plastic soles and uppers. Protective soles and uppers intended for use at sites which contain chemical hazards are made with conventional materials which are selected according to the type of chemical hazards against which protection is sought. Suitable materials include butyl rubber, neoprene rubber, polyvinyl chloride, nitrile, and combinations of these materials. Alternative embodiments of the sole provide protection against punctures by incorporating a metal plate or mesh throughout a substantial portion of the sole's area, including without limitation the mid-sole area. Other embodiments include conductive rubber for dissipating static electricity.

The toe box is positioned between two layers of a bifurcated portion of the protective upper to substantially cover and protect the user's toes and the toe portion of the user's street shoe. In order to be impact-resistant and compression-resistant, the toe box is formed of a conventional rigid material. Suitable rigid materials include steel, rigid plastic, and fiberglass. The toe box preferably has at least an I30 impact-resistance rating under a standard for toe boxes which was promulgated by the American National Standards Institute, Inc. (ANSI), and at least a C30 compression-resistance rating under that standard.

Alternative embodiments of the protective overshoe are designed to provide additional protection against industrial hazards. For instance, one embodiment includes a metatarsal guard which is connected to the protective sole either directly or by way of the protective upper. The metatarsal guard protects the metatarsal regions of the user's foot and street shoe against impact and compression hazards. Other embodiments have I50 or I75 impact-resistance ratings under the ANSI standard and C50 or C75 compression-resistance ratings. Some embodiments protect against impact, compression, and chemical hazards, while other protect against impact, compression, and puncture hazards or against other hazard combinations.

One embodiment includes a flexible upper whose height is about one-half of the upper's length from its heel to its toe.

In other embodiments, the upper extends over the user's ankles. In still other embodiments, the upper extends up along the user's calf.

Some embodiments include a strap, which is attached to the upper, and a strap securement, which is also attached to the upper at a distance from the base of the strap. The overshoe may then be tightened about the street shoe by securing the strap to the strap securement. The strap is secured by conventional means such as laces, buckles, or hook-and-loop fasteners.

The present invention also provides a method of protecting a foot from hazards, and of simultaneously protecting a street shoe which is secured about the foot. The street shoe and the foot together define a protected combination whose exterior surface will be protectively covered. A protective overshoe which has a toe box that is impact-resistant and compression-resistant is selected. The overshoe has an interior volume configured to contain the protected combination and to substantially conform to the exterior surface of the protected combination. The exterior surface of the protected combination is substantially covered with the protective overshoe while the street shoe is secured about the user's foot.

The overshoe is positioned so that its toe box protects the user's toes and the toe portion of the user's street shoe. The sole and upper of the overshoe are flexible. Thus, the overshoe is put on over the user's street shoe by bending the overshoe's sole to bring its heel closer to its toe, inserting the protected combination into the interior of the overshoe, and allowing the resilient sole to resume an unbent position. If the overshoe is equipped with a strap, the strap is then tightened.

In summary, the present invention protects the user's foot and street shoes from industrial hazards without requiring removal of the user's street shoes. The exterior of the overshoe as is relatively smooth, so it provides protection without increasing the risk that a person using the protection will trip. The overshoe is also flexible and hence compactable for easy storage.

These and other features and advantages of the present invention will become more fully apparent through the following description and appended claims taken in conjunction with the accompanying drawings.

BRIEF DESCRIPTION OF THE DRAWINGS

In order that the manner in which the above-recited and other advantages and features of the invention are obtained, a more particular description of the invention summarized above will be rendered by reference to the appended drawings. Understanding that these drawings only provide a selected embodiment of the invention and are not therefore to be considered limiting of its scope, the invention will be described and explained with additional specificity and detail through the use of the accompanying drawings in which.

DETAILED DESCRIPTION OF THE PREFERRED EMBODIMENTS

Figure 1:
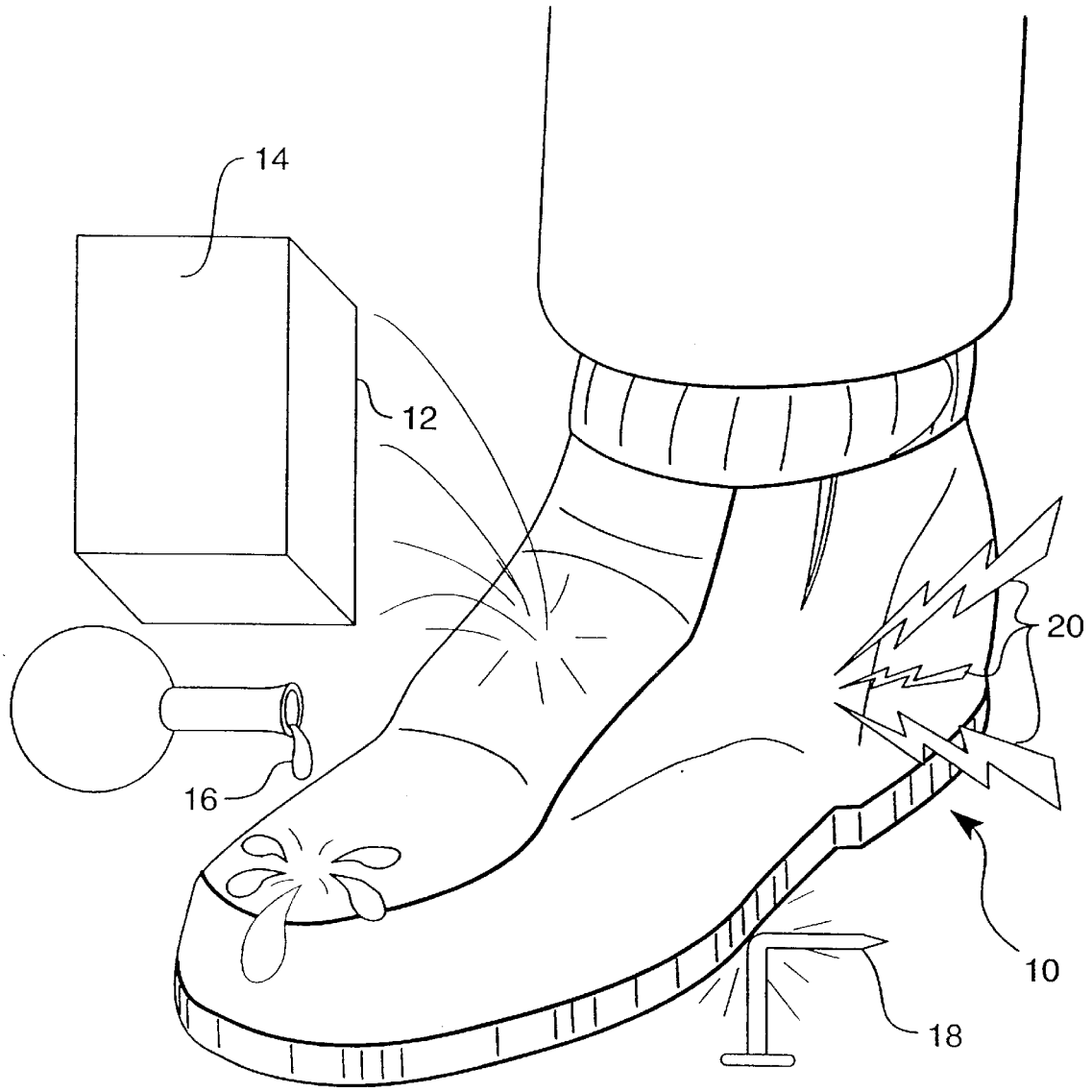
FIG. 1 is a perspective view of one embodiment of the overshoe of the present invention including a schematic diagram illustrating particular industrial hazards against which the invention protects.

Reference is now made to the figures wherein like parts are referred to by like numerals. The present invention relates to a protective overshoe such as the overshoe depicted generally at 10 in the schematic diagram of FIG. 1. The protective overshoe 10 reduces the risk of injury from various industrial hazards. Different embodiments of the overshoe 10 protect against different hazards, including without limitation impact hazards 12, compression hazards 14, chemical hazards 16, puncture hazards 18, and electrical hazards 20.

Figure 2:
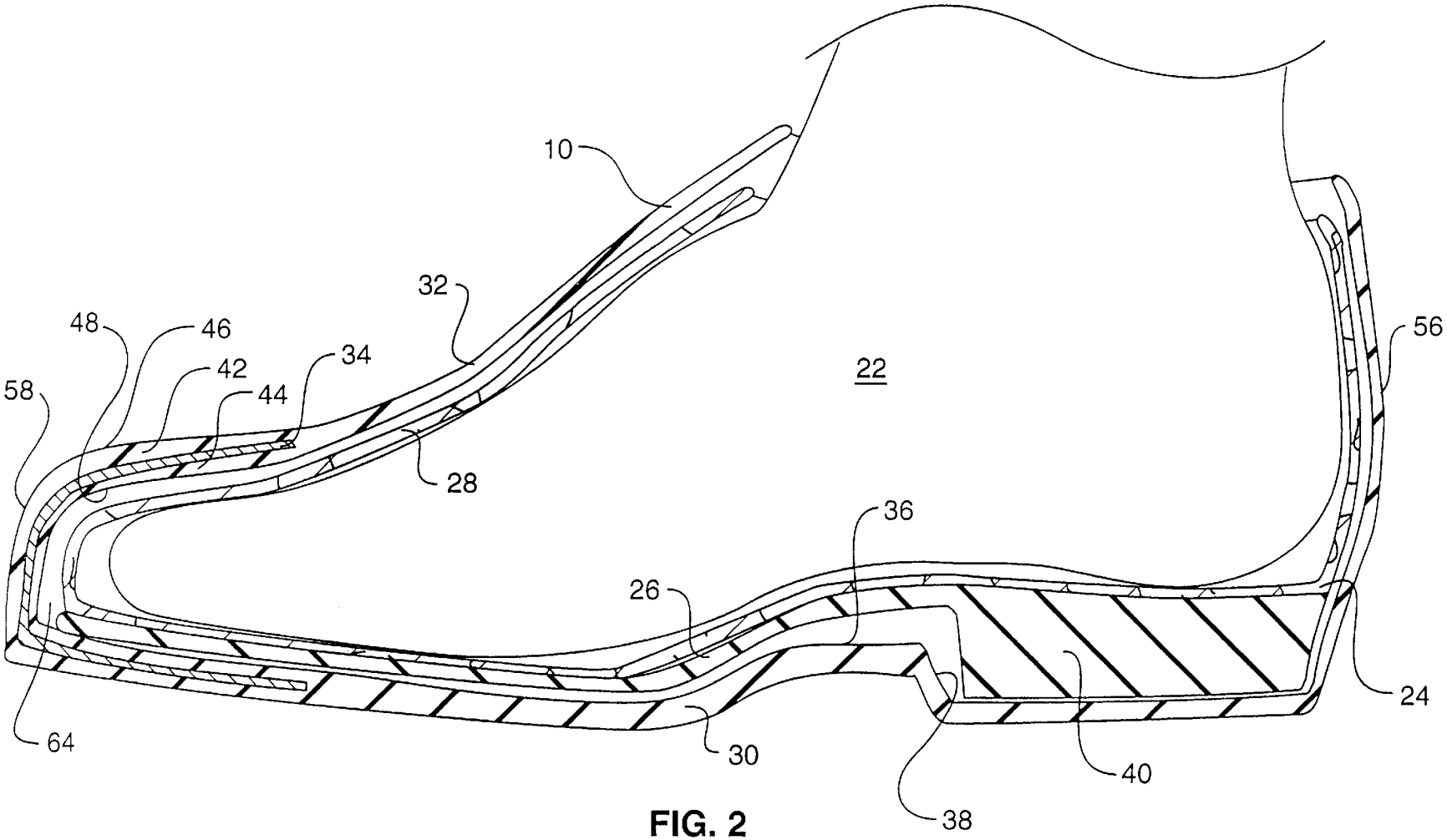
FIG. 2 is a partial cross-sectional view illustrating a preferred embodiment of the overshoe which protectively contains a conventional street shoe and a user's foot.

Unlike conventional protective devices, the overshoe 10 of the present invention simultaneously protects both a foot 22 and a street shoe 24 which is being worn by the foot 22, as shown in FIG. 2. The street shoe 24 includes a conventional sole 26 and a conventional upper 28. Although the street shoe 24 illustrated is a dress shoe, those of skill in the art will appreciate that the overshoe of the present invention may also be shaped and sized to effectively protect running shoes, sandals, boots, pumps, socks, slippers, men's shoes, women's shoes, and even children's shoes from industrial hazards.

As illustrated in FIG. 2, a presently preferred embodiment of the overshoe 10 includes a protective sole 30, a protective upper 32, and a toe box 34. The effectiveness of toe boxes and other foot protection devices may be measured. In particular, standards for quantifying the impact resistance, compression resistance, puncture resistance, and several other characteristics of protective footwear have been established by the American National Standards Institute, Inc. (ANSI). One such standard, referred to herein as "the ANSI standard," is ANSI standard number Z-41-1983. Other standards, such as measurements of resistance to various chemical hazards, are widely available to those of skill in the art.

The protective sole 30 is large enough to substantially cover the sole 26 of the street shoe 24, and preferably large enough to completely cover the sole 26. The inner side 36 of the protective sole 30 is preferably provided with a heel cavity 38 for receiving the heel 40 of the street shoe 24. The heel cavity 38 helps provide a secure, comfortable fit of the street shoe 24 within the overshoe 10. The heel cavity 38 helps prevent movement of the street shoe 24 inside the overshoe 10 while the overshoe is in use. In addition, the heel cavity 38 helps keep the toes and heel of the user's foot at the same relative distance from the floor within the overshoe 10 as when the street shoe 24 is outside the overshoe 10.

The materials used to form the protective sole 30 are selected according to the hazards the sole 30 is designed to guard against. Embodiments of the overshoe 10 which are intended to protect principally against impact or compression hazards contain soles 30 formed of conventional leather, rubber, or plastic materials.

However, protective soles 30 intended for use at sites which contain chemical hazards are preferably made with materials that protect against such hazards. Suitable materials are widely known and readily obtained by those of skill in the art, and include, without limitation, butyl rubber, neoprene rubber, polyvinyl chloride, nitrile, acrylonitrile, and combinations of these materials.

Other embodiments of the overshoe are intended to protect against electrical hazards. Such embodiments are of two general types. Some overshoes are intended for use in environments where the accumulation of static electricity on the body is a hazard. For instance, the overshoe may be worn near sensitive explosive mixtures. The sole of such overshoes includes conventional conductive rubber for dissipating static electricity. Such overshoes should not be worn near open electrical circuits.

Other overshoe embodiments are intended for use by personnel working near high-voltage lines where safety requires that the potential of the person and nearby energized parts must be equalized. The soles of such overshoes comprise conventional materials which have adequate resistance to protect the user. Typical resistances are specified by the ANSI standard identified above.

With continued reference to FIG. 2, the protective upper 32 of the overshoe 10 is large enough to substantially cover the upper 28 of the street shoe 24. The protective upper 32 is secured to the protective sole 30 by conventional means such as stitching, one-piece molding, or adhesive bonding. To make the overshoe 10 easy to put on and take off, the protective upper 32 and the protective sole 30 are preferably formed of flexible materials or otherwise provided with a joint or with flexing or bending capability.

The protective upper 32 is formed from materials selected according to the hazards likely to be encountered by the overshoe 10. For instance, uppers 32 intended for use at sites which contain chemical hazards are made of the same or similar materials as those used in the protective soles 30 under such conditions.

Protection against impact and compression hazards is provided principally by the toe box 34. The toe box 34 is larger than conventional toe boxes, in order to accommodate both the user's foot 22 and the toe portion of the user's street shoe 24. In the preferred embodiment shown, the toe box 34 is positioned between two layers 42, 44 of a bifurcated portion of the protective upper 32. In one alternative embodiment, the toe box 34 is connected directly to the exterior surface 46 of the protective upper 32; in another, the toe box 34 is directly connected to the protective sole 30 and positioned adjacent the interior surface 48 of the protective upper 32. Those of skill in the art will readily appreciate that a variety of connections may be employed, provided that the toe box 34 is secured to the overshoe 10 in a manner that permits it to receive, cover, and protect the user's toes.

In order to be impact-resistant and compression-resistant, the toe box 34 is formed of a conventional rigid material. Suitable rigid materials include steel, rigid plastic, fiberglass, and composite materials. Composite materials comprise graphite, carbon, glass, aramid, or other fibers bound together by a thermoset or thermoplastic resin binder such as an epoxy.

The toe box 34 preferably has at least an I30 impact-resistance rating under the ANSI standard for toe boxes. The toe box 34 preferably also has at least a C30 compression-resistance rating under the ANSI standard. Alternative embodiments have higher ratings, including but not limited to the I50 and I75 ratings for impact-resistance and the C50 and C75 ratings for compression-resistance.

Figure 3:
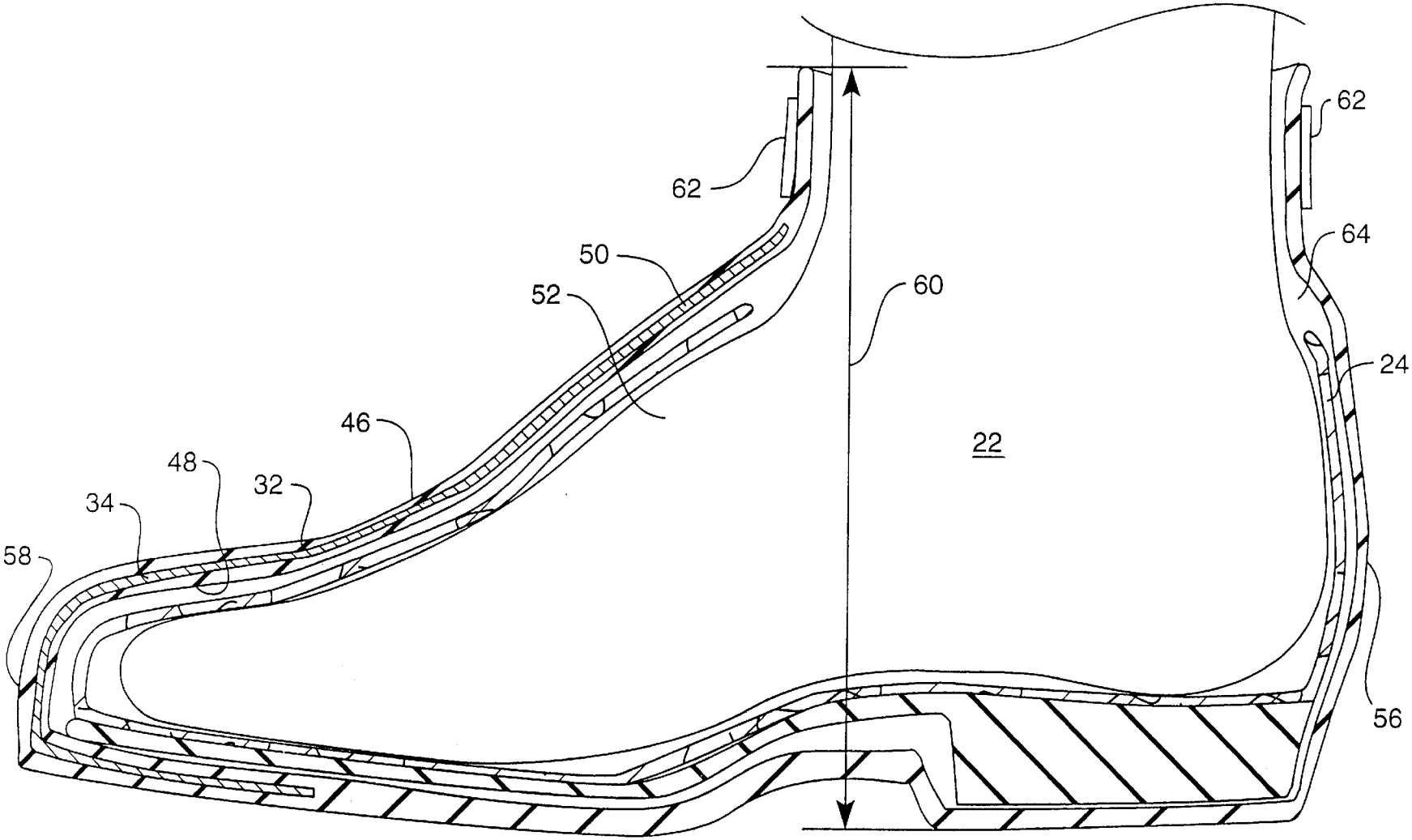
FIG. 3 is a partial cross-sectional view illustrating an alternative embodiment of the overshoe which covers at least a portion of the user's ankle and which includes a metatarsal guard.

Alternative embodiments of the protective overshoe are designed to provide additional protection against industrial hazards. For instance, FIG. 3 illustrates an embodiment which includes a metatarsal guard 50 for protecting the metatarsal region 52 of the user's foot 22 against impact and compression hazards. The metatarsal guard 50 is formed of conventional materials such as metal, plastic, fiberglass, or composite materials.

The metatarsal guard 50 illustrated in FIG. 3 is embedded within the protective upper 32 and is an integral homogeneous extension of the toe box 34. However, those of skill in the art will appreciate that the metatarsal guard of the present invention may also be a separate piece from the toe box, and that the metatarsal guard may also be positioned against either the interior surface 48 or the exterior surface 46 of the upper 32. In addition, the metatarsal guard preferably has a rating of at least Mt30 under the ANSI standard, but may also have higher ratings, such as Mt50 or Mt75.

Figure 4:
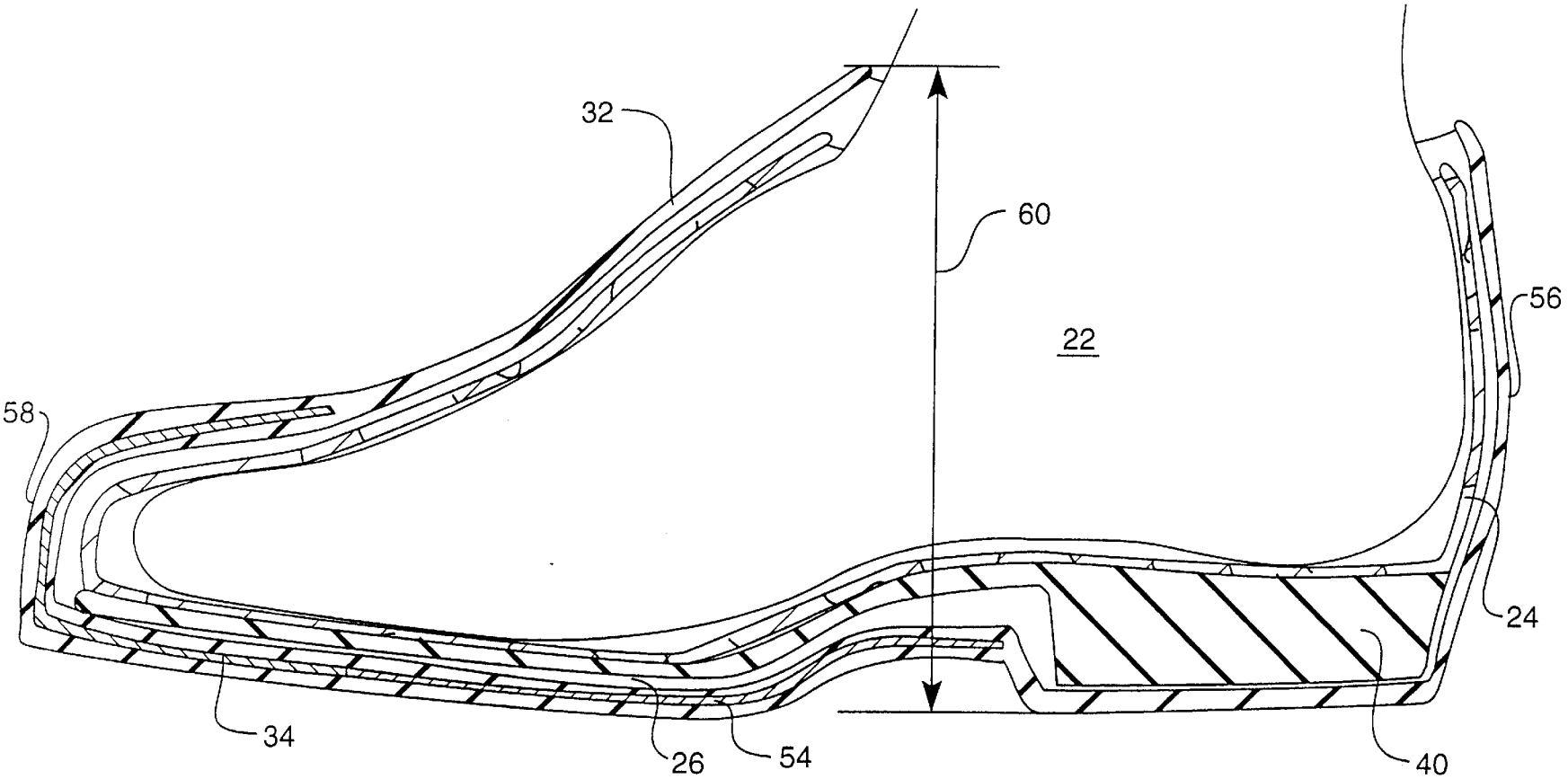
FIG. 4 is a partial cross-sectional view illustrating an alternative embodiment of the overshoe which includes a puncture guard.

As shown in FIG. 4, alternative embodiments of the overshoe also provide protection against puncture hazards. The embodiment illustrated includes a metal plate 54 which serves as a puncture guard to provide protection against punctures throughout a substantial portion of the street shoe sole 26. The metal alloy employed, and the thickness of the plate 54, are readily determined by those of skill in the art once the puncture hazard is known by reference to the ANSI standard for sole puncture resistance footwear and other conventional sources of information.

Although the puncture guard 54 illustrated is a metal plate, in alternative embodiments a composite plate, a metal mesh, or other puncture-resistant materials may be employed. Moreover, the puncture guard 54 may be extended to protect the heel 40 of the street shoe 24 against punctures. The puncture guard 54 may be rectangular, substantially footprint-shaped (including the arch area), or any other suitable shape. The puncture guard preferably protects at least the mid-sole area of the foot 22.

The overshoe embodiments illustrated in FIGS. 2 and 4 are relatively low-cut in that they cover little more than a typical dress shoe. In each, the upper 32 has a height 60 which is about one-half of the upper's length from the heel 56 to the toe 58. In the embodiment of FIG. 3 and in other embodiments, however, the upper 32 extends over at least a portion of the user's ankles. In the embodiment illustrated in FIG. 7, the upper extends up along the user's calf to protect boots and/or a portion of the user's pants.

Figure 5:
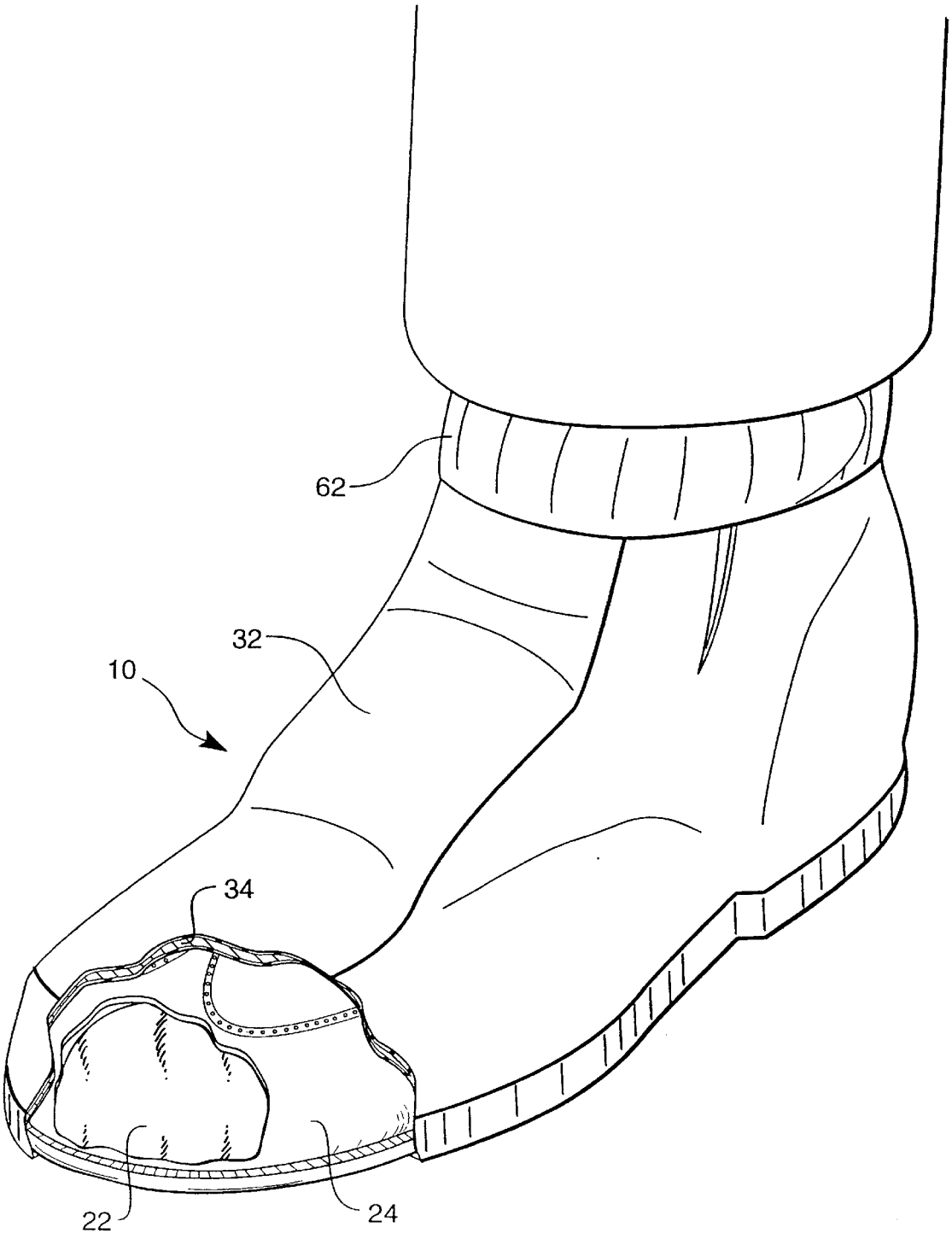
FIG. 5 is a partial cut-away perspective view illustrating an alternative embodiment in which the overshoe of the present invention is equipped with a strap.
Figure 7:
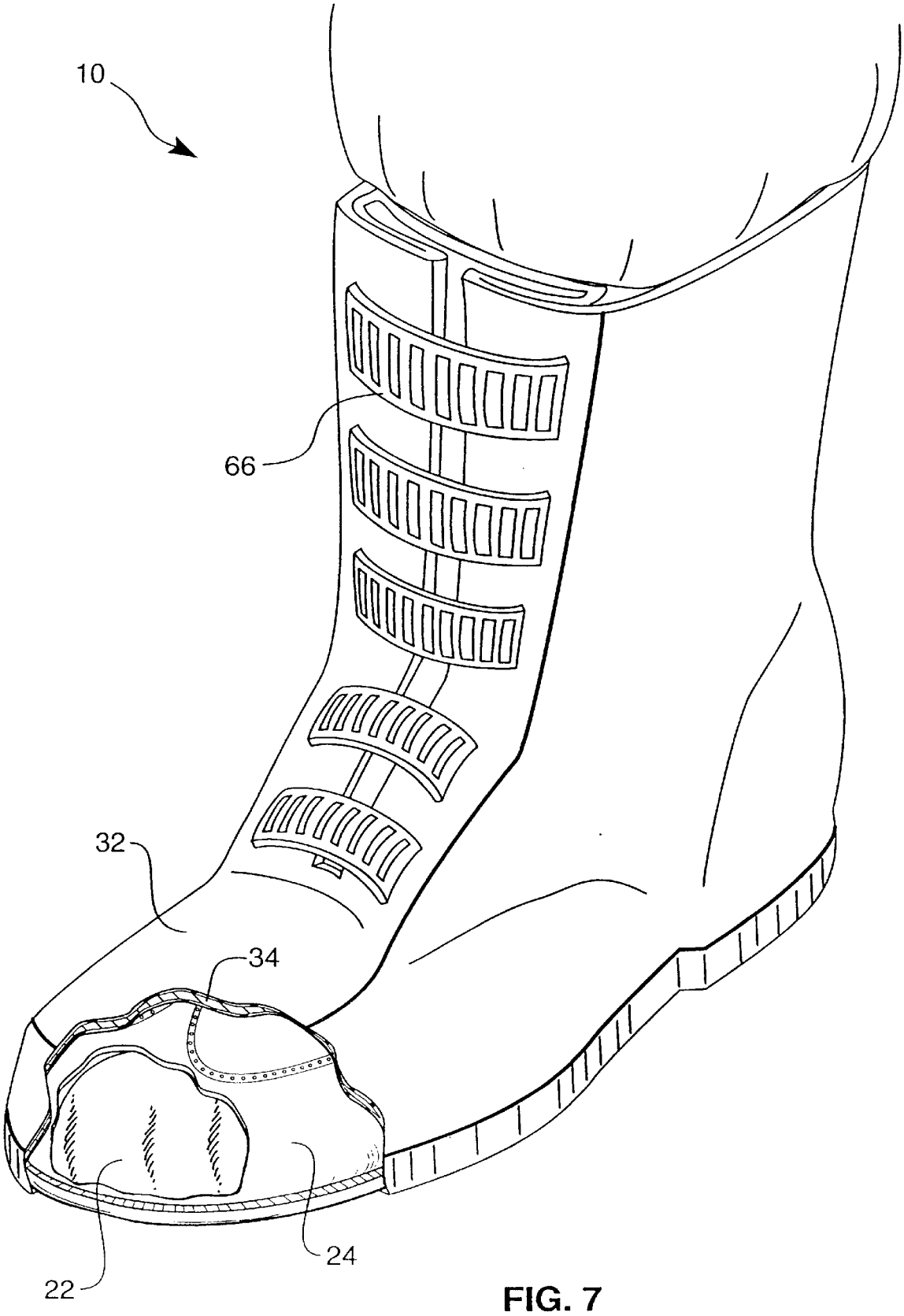
FIG. 7 illustrates an alternative embodiment of the overshoe which is suitable for protecting boots or other street shoes that extend above the user's ankles.

FIGS. 3 and 5 illustrate an embodiment in which a strap 62 is attached to the upper 32. A strap securement (not shown) is also attached to the upper 32 at a distance from the attached base of the strap 62. The overshoe 10 may then be tightened about the street shoe by securing the strap 62 to the strap securement. The strap 62 is formed of leather, rubber, nylon, or other materials, depending upon the hazards the strap is expected to resist. The strap 62 is secured by conventional means such as laces, buckles, or hook-and-loop fasteners. As shown in FIG. 7, conventional latch fasteners 66 may also be employed.

Figure 6:
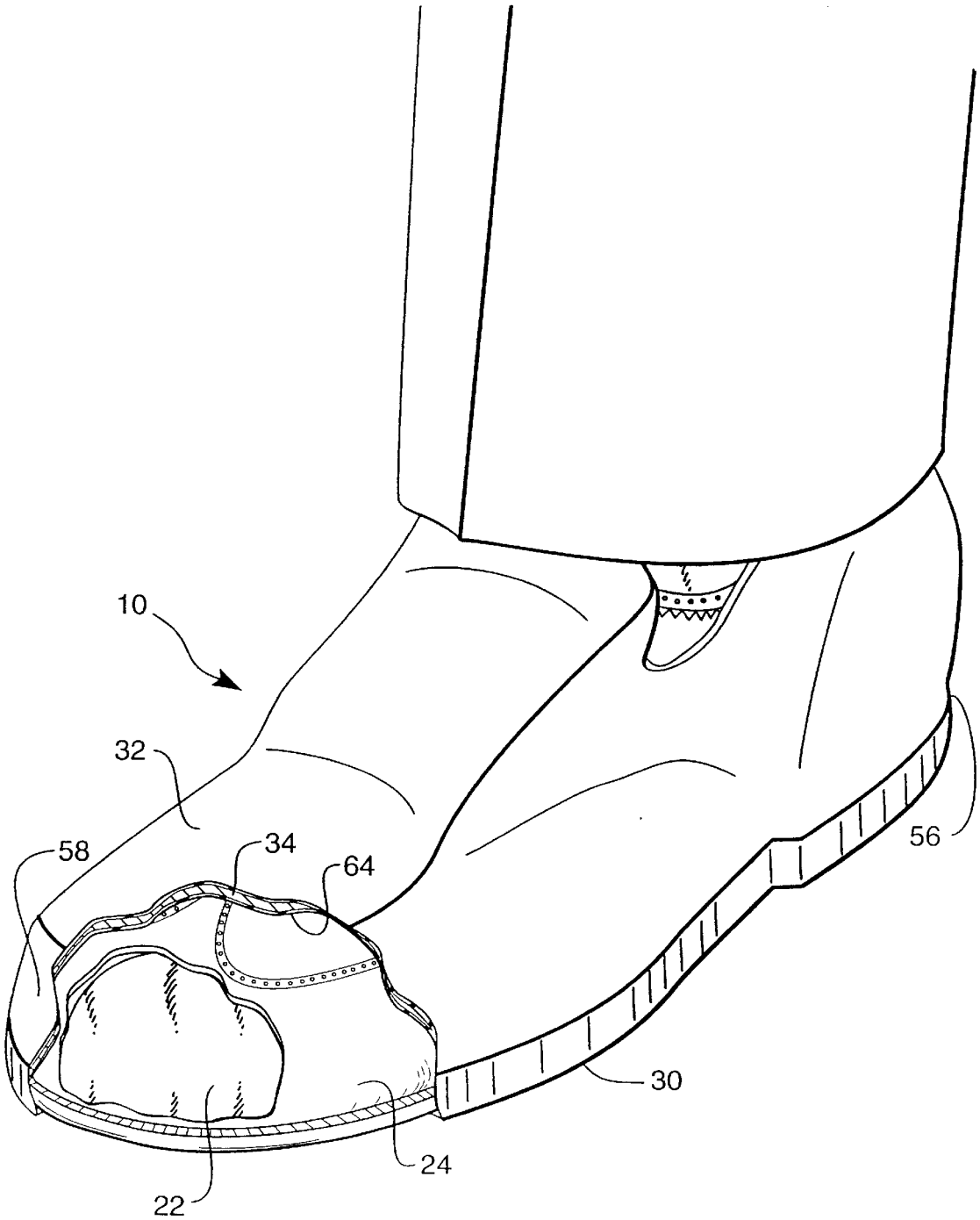
FIG. 6 is a partial cut-away perspective view further illustrating the overshoe and street shoe shown in FIG. 1.

With reference to FIG. 6, the present invention also provides a method for protecting the foot 22 from hazards, and for simultaneously protecting the street shoe 24 which is secured about the foot 22. The street shoe 24 and the foot 22 together define a protected combination whose exterior surface will be protectively covered. The exterior surface of the protected combination may coincide substantially with that of the street shoe 24, as in the situation illustrated. Or the combination's surface may include both the surface of a street shoe and a portion of the surface of a sock or a foot located within the street shoe. For instance, the street shoe may be a sandal, or the protective overshoe may extend further toward the user's knee than the street shoe extends.

According to the present method, a protective overshoe 10 which has a toe box 34 that is impact-resistant and compression-resistant is selected. The overshoe 10 has an interior volume 64 configured to contain the protected combination and to substantially conform to the exterior surface of the protected combination.

Next, the exterior surface of the protected combination is substantially covered with the protective overshoe while the street shoe 24 is secured about the user's foot 22. The overshoe 10 is thus positioned so that its toe box 34 protects the toes of the foot 22.

The sole 30 and upper 32 of the overshoe 10 are preferably flexible. Thus, the overshoe 10 is put on by bending the over-shoe's sole 30 to bring its heel 56 closer to its toe 58, inserting the protected combination into the interior 64 of the over-shoe 10, and allowing the resilient sole 30 to resume an unbent position. If the overshoe 10 is equipped with a strap 62 (FIG. 5), the strap 62 is then tightened.

In summary, the present invention provides foot and street shoe protection which does not require users employing the protection to replace their street shoes with workboots. Instead, the overshoe is secured over the street shoe and foot while the street shoe is still being worn by the user. The overshoe protects the user's foot and street shoes from impact, compression, chemical, puncture, and/or electrical hazards. Moreover, the exterior of the overshoe is relatively smooth, unlike conventional external guards, so the overshoe provides protection without increasing the risk that a person using the protection will trip.

The invention may be embodied in other specific forms without departing from its spirit or essential characteristics. The described embodiments are to be considered in all respects only as illustrative and not restrictive. Any explanations provided herein of the scientific principles employed in the present invention are illustrative only. The scope of the invention is, therefore, indicated by the appended claims rather than by the foregoing description. All changes which come within the meaning and range of equivalency of the claims are to be embraced within their scope.

What is claimed and desired to be secured by patent is:

1. A protective overshoe for protecting a foot housed within a street shoe, said street shoe having a sole and an upper, said overshoe comprising:

a protective sole configured such that it substantially covers the sole of a street shoe placed within said overshoe;

a protective upper secured to said protective sole and configured such that it substantially covers the upper of a street shoe placed within said overshoe; and a protective toe box connected to said protective upper, said toe box having an ANSI standard impact-resistance rating of at least I-30, said toe box in combination with said protective upper and said protective sole substantially defining a protective chamber which is dimensioned and configured to contain said street shoe and to contain a foot wearing said street shoe.

2. The protective overshoe of claim 1, wherein said toe box is impact-resistant and compression-resistant.

3. The protective overshoe of claim 1, wherein said protective upper is a chemical hazard resistant upper.

4. The protective overshoe of claim 1, wherein said protective upper comprises a flexible material.

5. The protective overshoe of claim 1, wherein said toe box comprises steel.

6. The protective overshoe of claim 1, wherein said toe box comprises rigid plastic.

7. The protective overshoe of claim 1, wherein said toe box comprises fiberglass.

8. The protective overshoe of claim 1, further comprising a metatarsal guard.

9. The protective overshoe of claim 1, wherein said protective overshoe sole further comprises a sole guard for resisting sole punctures.

10. The protective overshoe of claim 1, wherein said protective overshoe sole comprises conductive rubber for dissipating static electricity.

11. A protective overshoe for containing a street shoe having a toe and a heel, the protective overshoe comprising:

a sole;

a heel cavity defined on all sides by a continuous sidewall to accommodate the heel of a street shoe and to prevent the heel of the street shoe from sliding forward when the street shoe is place within the protective overshoe;

an upper formed of rubber attached to said sole, said rubber upper allowing entry of a close-fitting street shoe within the protective overshoe; and a protective toe box disposed within said upper and having a compression resistance of at least 30 pounds and an impact resistance of at least 30 pounds;

said sole and said upper being configured such that said street shoe is capable of being disposed within the space defined by said sole and said upper, and such that said toe of said street shoe is capable of residing within said protective toe box.

12. A protective overshoe as defined in claim 11, wherein said protective toe box is disposed between two layers of rubber.

13. A protective overshoe as defined in claim 11, wherein said protective upper is a chemical hazard resistant upper.

14. A protective overshoe as defined in claim 11, wherein said protective upper comprises a flexible material.

15. A protective overshoe as defined in claim 11, wherein said toe box comprises steel.

16. A protective overshoe as defined in claim 11, wherein said toe box comprises rigid plastic.

17. A protective overshoe as defined in claim 11, wherein said toe box comprises fiberglass.

18. A protective overshoe as defined in claim 11, further comprising a metatarsal guard connected to said protective overshoe sole.

19. A protective overshoe as defined in claim 11, wherein said protective overshoe sole further comprises a sole guard attached to and forming a portion of said sole for resisting sole punctures.

20. A protective overshoe as defined in claim 11, wherein said protective overshoe sole comprises conductive rubber for dissipating static electricity.

* * * * *